US007144483B2

(12) United States Patent
Siljan et al.

(10) Patent No.: US 7,144,483 B2
(45) Date of Patent: Dec. 5, 2006

(54) METHOD AND AN ELECTROWINNING CELL FOR PRODUCTION OF METAL

(75) Inventors: Ole-Jacob Siljan, Skien (NO); Stein Julsrud, Skien (NO)

(73) Assignee: Norsk Hydro ASA, Oslo (NO)

( * ) Notice: Subject to any disclaimer, the term of this patent is extended or adjusted under 35 U.S.C. 154(b) by 334 days.

(21) Appl. No.: 10/468,861

(22) PCT Filed: Feb. 13, 2002

(86) PCT No.: PCT/NO02/00063

§ 371 (c)(1),
(2), (4) Date: Nov. 5, 2003

(87) PCT Pub. No.: WO02/066709

PCT Pub. Date: Aug. 29, 2002

(65) Prior Publication Data

US 2004/0112757 A1 Jun. 17, 2004

(30) Foreign Application Priority Data

Feb. 23, 2001 (NO) ..... 20010927

(51) Int. Cl.
*C22C 3/08* (2006.01)
*C22C 3/22* (2006.01)

(52) U.S. Cl. ..... 204/247; 204/246; 204/256; 204/258; 204/265; 204/266; 204/277; 204/278

(58) Field of Classification Search ..... None
See application file for complete search history.

(56) References Cited

U.S. PATENT DOCUMENTS 3,909,375 A * 9/1975 Holliday et al. ..... 205/375
5,006,209 A 4/1991 Beck et al.
5,660,710 A 8/1997 Sivilotti
5,725,744 A 3/1998 Nora et al.

FOREIGN PATENT DOCUMENTS

NO 134495 7/1976

* cited by examiner

*Primary Examiner*—Roy King
*Assistant Examiner*—Michael P. Alexander
(74) *Attorney, Agent, or Firm*—Wenderoth, Lind & Ponack, L.L.P.

(57) ABSTRACT

The present invention relates to a method for production of molten aluminium by electrolysis of an aluminous ore, preferably alumina, in a molten salt mixture, preferably a sodium fluoride—aluminium fluoride-based electrolyte. The invention describes an electrolysis cell for said production of aluminium by use of essentially inert electrodes in a vertical an/or inclined position, where said cell design facilitates separation of aluminium and evolved oxygen gas by providing a gas separation chamber (14) arranged in communication with the electrolysis chamber (22), thus establishing an electrolyte flow between the electrolysis chamber (22) and the gas separation chamber (14).

37 Claims, 2 Drawing Sheets

METHOD AND AN ELECTROWINNING CELL FOR PRODUCTION OF METAL

Figure 1:
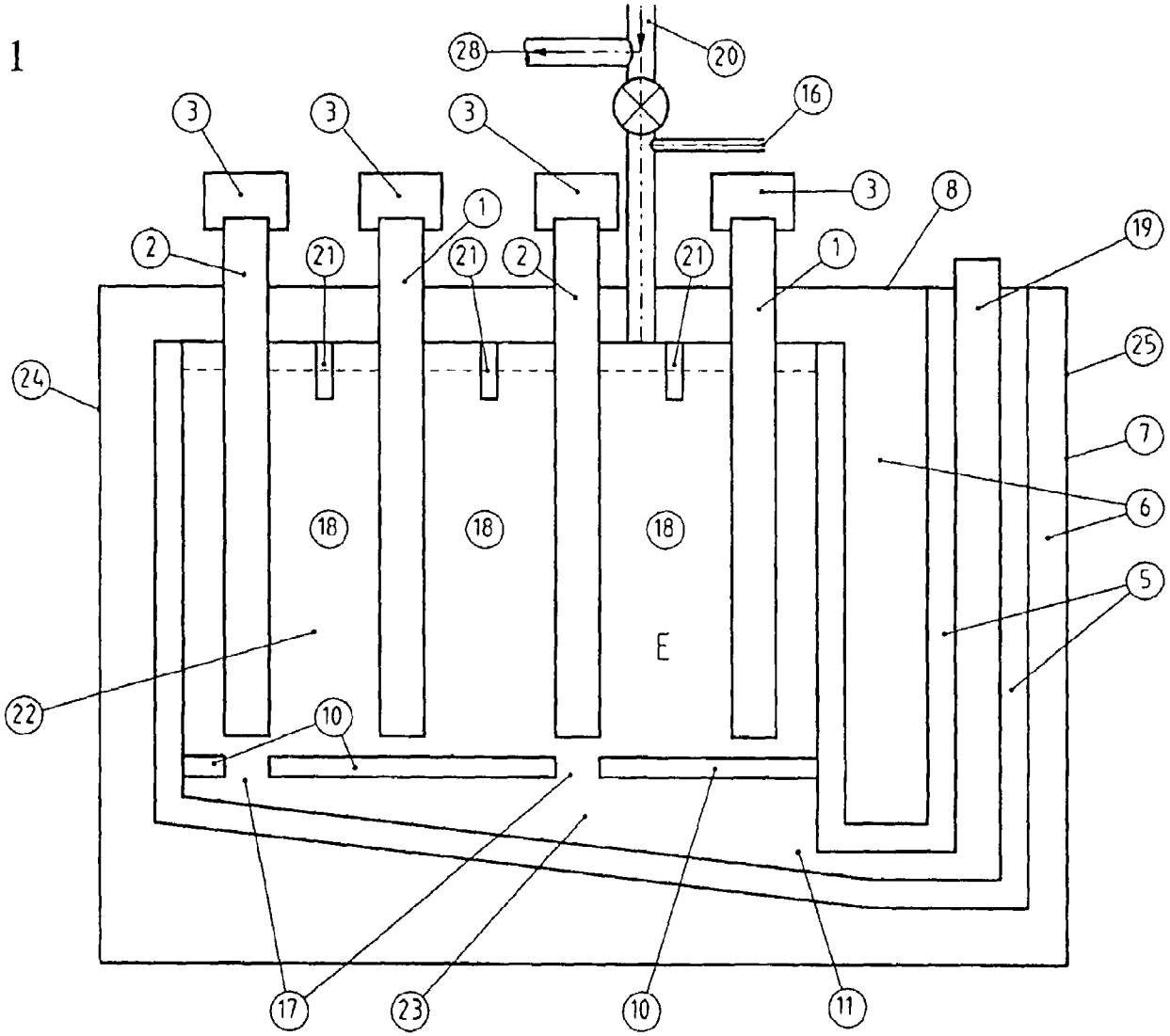

The present invention relates to a method and an electrowinning cell for the production of aluminium, in particular electrowinning of aluminium by the use of substantially inert electrodes.

Aluminium is presently produced by electrolysis of an aluminium-containing compound dissolved in a molten electrolyte, and the electrowinning process is performed in cells of conventional Hall-Hèroult design. These electrolysis cells are equipped with horizontally aligned electrodes, where the electrically conductive anodes and cathodes of today's cells are made from carbon materials. The electrolyte is based on a mixture of sodium fluoride and aluminium fluoride, with smaller additions of alkaline and alkaline earth fluorides. The electrowinning process takes place as the current passed through the electrolyte from the anode to the cathode causes the electrical discharge of aluminium-containing ions at the cathode, producing molten aluminium, and the formation of carbon dioxide at the anode (see Haupin and Kvande, 2000). The overall reaction of the process can be illustrated by the equation:

$$2Al_2O_3+3C=4Al+3CO_2 \quad (1)$$

Due to the horizontal electrode configuration, the preferred electrolyte composition and the use of consumable carbon anodes, the currently used Hall-Hèroult process displays several shortcomings and weaknesses. The horizontal electrode configuration renders necessary an area-intensive design of the cell, which results in a low aluminium production rate relative to the footprint of the cell. The low productivity to area ratio causes high investment cost for greenfield primary aluminium plants.

The traditional aluminium production cells utilise carbon materials as the electrically conductive cathode. Since carbon is not wetted by molten aluminium, it is necessary to maintain a deep pool of molten aluminium metal above the carbon cathode, and it is in fact the surface of the aluminium pool that is the "true" cathode in the present cells. A major drawback of this metal pool is that the high amperage of modern cells (>150 kA) creates considerable magnetic forces, disturbing the flow patterns of the electrolyte and the metal in the electrowinning cells. As a result, the metal tends to move around in the cell causing wave movements that might locally shortcut the cell and promote dissolution of the produced aluminium into the electrolyte. In order to overcome this problem, complex busbar systems are designed to compensate for the magnetic forces and to keep the metal pool as stable and flat as possible. The complex busbar system is costly, and if the disturbance of the metal pool is too large, aluminium dissolution in the electrolyte will be enhanced, resulting in reduced current efficiency due to the back reaction:

$$2Al+3CO_2=Al_2O_3+3CO \quad (2)$$

The preferred carbon anodes of today's cells are consumed in the process according to reaction (1), with a typical gross anode consumption of 500 to 550 kg of carbon per tonne of aluminium produced. The use of carbon anodes results in the production of pollutant greenhouse gases like $CO_2$ and CO in addition to the so-called PFC gases ($CF_4$, $C_2F_6$, etc.). The consumption of the anode in the process means that the interpolar distance in the cell will constantly change, and the position of the anodes must be frequently adjusted to keep the optimum operating interpolar distance. Additionally, each anode is replaced with a new anode at regular intervals. Even though the carbon material and the manufacture of the anodes are relatively inexpensive, the handling of the used anodes (butts) makes up a major portion of the operating cost in a modern primary aluminium smelter.

The raw material used in the Hall-Hèroult cells is aluminium oxide, also called alumina. Alumina has a relatively low solubility in most electrolytes. In order to achieve sufficient alumina solubility, the temperature of the molten electrolyte in the electrowinning cell must be kept high. Today, normal operating temperatures for Hall-Hèroult cells are in the range 940–970° C. To maintain the high operating temperatures, a considerable amount of heat must be generated in the cell, and the major portion of the heat generation takes place in the interpolar space between the electrodes. Due to the high electrolyte temperature, the side walls of today's aluminium production cells are not resistant to the combination of oxidising gases and cryolite-based melts, so the cell side linings must be protected during cell operation. This is normally achieved by the formation of a crust of frozen bath ledge on the side walls. The maintenance of this ledge necessitates operating conditions where high heat losses through the side walls is a necessary requirement. This results in the electrolytic production having an energy consumption that is substantially higher that the theoretical minimum for aluminium production. The high resistance of the bath in the interpolar space accounts for 35–45% of the voltage losses in the cell. The state-of-the-art of present technology is cells operating at current loads in the range 250–350 kA, with energy consumption around 13 kWh/kg Al and a current efficiency of 94–95%.

The carbon cathodes used in the traditional Hall-Hèroult cells are vulnerable to sodium swelling and erosion, and both of these can cause cell life reduction.

As pointed out, there are several good reasons for improving the cell design and the electrode materials in aluminium electrolysis cells, and several attempts have been made to obtain these improvements. One possible solution to overcome some of the problems experienced in the presently used Hall-Hèroult cells, is the introduction of so-called wettable (or inert) cathodes. The introduction of aluminium wettable cathodes has been suggested in several patents, among others U.S. Pat. Nos. 3,400,036, 3,930,967 and 5,667,664. All of the patents in this field of invention are aimed at reducing the energy consumption during aluminium electrolysis through the implementation of so-called aluminium wettable cathode materials. The energy reduction during electrolysis is accomplished by the construction of an electrolytic cell with drained cathodes, allowing for cell operation without the presence of an aluminium pool. Most of the patents are related to the retrofit of the conventional Hall-Hèroult cell types, although some presuppose the introduction of novel cell designs. Wettable cathodes are proposed manufactured from so-called Refractory Hard Materials (RHM) like borides, nitrides and carbides of the transition metals, and also RHM silicides are proposed as useful inert cathodes. The RHM cathodes are readily wetted by aluminium and hence a thin film of aluminium may be maintained on the cathode surfaces during aluminium electrowinning in drained cathode configurations. Due to the high cost of the RHM materials, the manufacture of RHM/graphite composites, for instance $TiB_2$—C composite, constitutes a viable alternative material for drained cathodes. The wettable cathodes can be inserted in the proposed electrolysis cells as solid cathode structures or as slabs, "mushrooms", lumps, plates, etc. The materials may also be applied as surface layers as slurries, pastes, etc., that adhere to the underlying substrate, usually carbon based, during start-up or preheating of the cell or cathode elements (for instance U.S. Pat. Nos. 4,376,690, 4,532,017 and 5,129,998). As proposed in these patents, the RHM cathodes may be inserted as "pre-cathodes" that partially floats on top of the underlying aluminium pool in the electrowinning cell, and as such decreases the interpolar distance and will also have a dampening effect on the metal movement in the cell bottom. Problems expected to be encountered during the operation of such "pre-cathode" cells are related to breaking of the shapes, stability of the mounted elements and long-time operational stability. Brown et al. (1998) have reported successful operation for a relatively short time period of Hall-Hèroult cells using $TiB_2$/C-composite wettable cathodes in a drained configuration, but as known to those skilled in the art, long-time operation will be problematic due to the dissolution of $TiB_2$ resulting in removal of the wettable cathode layer on top of the carbon cathode blocks. The introduction of wettable cathodes and so-called "pre-cathodes" in Hall-Hèroult cells with their horizontal electrode alignment, however, do not address the low area utilisation of said cells.

With an inert anode in the electrowinning of aluminium, the overall reaction would be:

$$2Al_2O_3=2Al+3O_2 \quad (3)$$

So far, no commercial-scale electrolysis cells have been operated successfully over longer periods of time with inert anodes. Many attempts have been made to find the optimum inert anode material and the introduction of these materials in electrolytic cells, and numerous patents have been proposed for inert anode materials for aluminium electrowinning. Most of the proposed inert anode materials have been based on tin oxide and nickel ferrites, where the anodes may be a pure oxide material or a cermet type material. The first work on inert anodes was initiated by C. M. Hall, who worked with copper metal (Cu) as a possible anode material in his electrolysis cells. Generally, the inert anodes can be divided into metal anodes, oxide-based ceramic anodes and cermets based on a combination of metals and oxide ceramics. The proposed oxide-containing inert anodes may be based on one or more metal oxides, wherein the oxides may have different functions, as for instance chemical "inertness" towards cryolite-based melts and high electrical conductivity. The proposed differential behaviour of the oxides in the harsh environment of the electrolysis cell is, however, questionable. The metal phase in the cermet anodes may likewise be a single metal or a combination of several metals (metal alloys). The main problem with all of the suggested anode materials is their chemical resistance to the highly corrosive environment due to the evolution of pure oxygen gas (1 bar) and the cryolite-based electrolyte. To reduce the problems of anode dissolution into the electrolyte, additions of anode material components (U.S. Pat. No. 4,504,369) and a self generating/repairing mixture of cerium based oxyfluoride compounds (U.S. Pat. Nos. 4,614,569, 4,680,049 and 4,683,037) have been suggested as possible inhibitors of the electrochemical corrosion of the inert anodes. However, none of these systems have been demonstrated as viable solutions.

When operating cells with inert anodes, one problem often run into is the accumulation of anode material elements in the aluminium produced. Several patents have tried to address these problems by suggesting a reduction in the cathode surface area, i.e. the surface of the aluminium produced. Reduced aluminium surface area exposed to the electrolytic bath will reduce the uptake of dissolved anode material components in the metal, and hence increase the durability of the oxide-ceramic (or metal or cermet) anodes in the electrolysis cells. This is amongst others described in U.S. Pat. Nos. 4,392,925, 4,396,481, 4,450,061, 5,203,971, 5,279,715 and 5,938,914 and in GB 2 076 021.

Other publications related to this technical field are as follows:

Haupin, W. and Kvande, H.: "*Thermodynamics of electrochemical reduction of alumina*", Light Metals 2000, 379–384.

Pawlek, R. P.: "*Aluminium wettable cathodes: An update*", Light Metals 1998, 449–454.

Brown, G. D., Hardie, G. J., Shaw, R. W. and Taylor, M. P.: "*$TiB_2$ coated aluminium reduction cells: Status and future direction of coated cells in Comalco*", Proceedings of the 6$^{th}$ Australasian Al Smelting Workshop, Queenstown, New Zealand, Nov.26, 1998.

The introduction of inert anodes and wettable cathodes in the present Hall-Hèroult electrowinning cells would have a significant impact on reducing the production of greenhouse gases like $CO_2$, CO and PFC's from aluminium production. Also, potentially the reduction in energy added would be substantial if a drained cathode design could be employed. However, in order to really make substantial progress in the optimisation of electrolytic aluminium production, both inert (dimensionally stable) anodes and wettable cathodes must be incorporated in a novel cell design. Novel cell designs can be divided into two groups, designs aimed at retrofit of existing Hall-Hèroult type cells, and completely new cell designs.

Patents regarding retrofit or enhanced development of Hall-Hèroult cells are amongst others described in U.S. Pat. Nos. 4,504,366, 4,596,637, 4,614,569, 4,737,247, 5,019,225, 5,279,715, 5,286,359 and 5,415,742, as well as GB 2 076 021. All of these patents address the problems encountered due to the high heat losses in the present Hall-Hèroult cells, and the electrolysis process is operated at reduced interpolar distances. Some of the proposed designs are in addition effective with respect to reducing the surface area of the liquid aluminium metal pad exposed to the electrolyte. However, only a few of the suggested designs have addressed the low production to area ratio of the Hall-Hèroult cells. Amongst others, U.S. Pat. Nos. 4,504,366, 5,279,715 and 5,415,742 have tried to solve this problem by implementation of vertical electrode configurations to increase the total electrode area of the cell. These three patents have also suggested the use of bipolar electrodes. The major problem of the cell design suggested in these patents, however, is that the requirement for a large aluminium pool on the cell bottom to provide electrical contact for the cathodes. This will render the cell susceptible to the influence of the magnetic fields created by the busbar system, and may hence cause local short-circuiting of the electrodes.

U.S. Pat. Nos. 4,681,671, 5,006,209, 5,725,744 and 5,938,914 describe novel cell designs for aluminium electrowinning. Also U.S. Pat. Nos. 3,666,654, 4,179,345, 5,015,343, 5,660,710 and 5,953,394, and Norwegian patent no. NO 134495 describe possible designs of light metal electrolysis cells, although one or more of these patents are oriented towards magnesium production. Most of these cell concepts arc applicable to multi-monopolar and bipolar electrodes. The common denominator of all of the above suggested cells designs is a vertical electrode configuration for the utilisation of the so-called gas lift effect. As gas is evolved at the anode it raises towards the surface of the electrolyte, creating a drag force that can be utilised to "pump" the electrolyte in the cell. By suitable arrangement of the anodes and cathodes, this gas-lift induced flow of electrolyte can be controlled. All of these prior patents claim better current efficiencies, purer metal quality and improved metal—gas separation properties. However, for the purpose of separating a produced metal that is denser than the electrolyte, one general impression of the prior patents, as for instance expressed in U.S. Pat. No. 5,660,710, is that the separation or partition wall does not extend deep enough in the electrolyte to accomplish this task. Additionally, several of the patents, for example Norwegian pat. No. 134495, introduce the term gas separation chamber merely by increasing the height of the free volume between the electrolyte level above the electrodes and the lid of the electrolytic cell. This design change is, however, not sufficient to assure the removal of finely dispersed oxygen bubbles in the electrolyte due to the high velocities of the electrolyte in the areas directly above and adjacent to the oxygen-evolving anodes in the cell.

Additionally, the referred patents, as well as U.S. Pat. No. 6,030,518, all point to the lowering of the bath temperature as compared to normal Hall-Hèroult cell temperatures as a means of a feasible reduction of the anode corrosion rates in the cell. The utilisation of the gas-lift effect and design of so-called up-comer and down-comer flow funnels are also described in U.S. Pat. No. 4,308,116, specially aimed at magnesium production.

U.S. Pat. No. 4,681,671 describes a novel cell design with a horizontal cathode and several, blade-shaped vertical anodes, and the cell is then operated at low electrolyte temperatures and with an anodic current density at or below a critical threshold value at which oxide-containing anions are discharged preferentially to fluoride anions. By means of forced or natural convection, the melt is circulated to a separate chamber or a separate unit, in which alumina is added before the melt is circulated back into the electrolysis compartment. Although the total surface area of the anode is high in the proposed configuration, the effective anode area is small and limited due to the low electrical conductivity of the anode material relative to the electrolyte. This will substantially limit the useful anodic surface area, and will lead to high corrosion rates at the effective anode surface.

The proposed cell design presented in U.S. Pat. No. 5,938,914 consists of inert anodes and wettable cathodes in a completely closed arrangement for ledge-free aluminium electrowinning. The cell is preferably constructed with a plurality of interleaved, vertical anodes and cathodes with an anode to cathode surface area ratio of 0.5–1.3. The bath temperature is in the range from 700° C. to 940° C., with 900–920° C. as the preferred operating range. The electrode assembly has outer walls that define a down-comer and an up-comer for the electrolyte flow induced by the gas-lift effect of the oxygen bubbles produced at the anode(s). A roof is placed above the anodes to collect the gas and to direct the evolved oxygen into the up-comer defined in the electrolysis chamber. The end cathodes are electrically connected to the cathode lead of the electrode assembly, whereas any interleaved cathode plates are electrically connected to the end cathode plates by means of the aluminium pool on the cell floor.

An aluminium electrowinning cell with vertical electrodes and a metal collection "sump" created by a drained cell floor design was proposed in U.S. Pat. No. 5,006,209. The electrolysis cell concept was designed for metal-based anodes and wettable cathodes where the electrolysis process takes place in a fluoride-containing electrolyte at low temperatures, and where the aluminium ore is solid and dissolved alumina is kept in suspension in the electrolyte. Again, the convection pattern of the electrolyte in the electrolysis cell is created by the so-called gas-lift effect due to oxygen-evolving anodes. The cell floor itself is an auxiliary non-consumable anode, or the anodes may have an inverted T-shape, and is as such an oxygen-evolving "bottom" anode. A possible problem of this design is that aluminium produced on the cathodes and flowing downward will be exposed to the oxygen gas produced at the "bottom" anode and hence contribute to reduced current efficiency through the back reaction. Additionally, if aluminium comes into contact with the oxide layer on the metal anode, an exothermic reaction between aluminium and the oxidised anodic layer will take place. This will contribute to loss of current efficiency in the cell as well as to the deterioration of the anode with subsequent contamination of the produced metal. Another problem that is expected to be encountered during long-time operation of the cell described in U.S. Pat. No. 5,006,209, is the accumulation of alumina-containing sludge in the cell bottom. This problem is expected due to the low solubility of alumina at the suggested operating temperatures, and the problems of keeping alumina freely suspended in the cell during varying cell operating conditions (i.e. temperature fluctuations, bath composition fluctuations and alumina quality fluctuations).

U.S. Pat. No. 5,725,744 proposes a different concept for a novel design of an aluminium electrowinning cell. The cell is designed for preferred operation at low temperatures, and thus requiring operation at low anodic current densities. The inert electrodes and wettable cathodes are aligned vertically, or practically vertically, in the cell, thus maintaining an acceptable cell footprint. The electrodes are aligned as several interleaved rows adjacent to the side walls of the cell or alternatively a single row of multi-monopolar electrodes along its length. The anode surface area, and possibly the cathode area, are increased by the use of a porous or reticulated skeletal structure, where the anode leads are introduced from the top of the cell and the cathode leads are introduced from the bottom or lower side walls. The cell operates with an aluminium pool on the cell floor. Spacers are used between or adjacent to the electrodes to maintain a fixed interpolar distance, and to provide the desired electrolyte flow pattern in the cell, i.e. an upward movement of the electrolyte flow in the interpolar spacing. The cell is likewise designed with a cell housing outside the electrodes that provides a downward movement of the electrolyte. Alumina is fed into the cell in the cell housing with the downward electrolyte flow. According to the present authors' understanding, one of the main problems encountered with the proposed cell design of the said U.S. patent is the shortcomings with respect to separation of the produced metal and electrolyte. A large aluminium pool is prescribed to be present at the cell floor level, thus as in other similar electrowinning cell designs a large surface area of molten aluminium is in contact with the electrolyte, enhancing the accumulation of dissolved anode material in the produced metal, and enhancing the dissolution of aluminium in the electrolyte. The latter problem will reduce the current efficiency of the cell through the back reaction with dissolved oxidising gas species, and the first will lead to reduced metal quality.

A fact well established in hydrodynamics is that the flow of a fluid system is governed by a balance between the driving force for fluid flow and the resistance to fluid flow within the components of the system. Furthermore, depending upon the configuration, the velocity within local regions flow may be in the same direction but may sometimes be in the direction opposite to the fluid drive. This principle is amongst others cited in U.S. Pat. Nos. 3,755,099, 4,151,061 and 4,308,116. Inclined electrode surfaces are used to enhance/facilitate the drainage of gas bubbles from the anode and molten metal from the cathode. Hence, the design of electrolysis cells with vertical or near horizontal electrodes of both multi-monopolar and bipolar electrode arrangement, where fixed interpolar distance and the gas-lift effect are used to create a forced convection of the electrolyte flow, is not new. U.S. Pat. Nos. 3,666,654, 3,779,699, 4,151,061 and 4,308,116, amongst others utilise such design principles, and the two latter patents also give descriptions of the use of "funnels" for up-comer(s) and down-comer(s) with respect to the electrolyte flow. U.S. Pat. No. 4,308,116 also suggests the use of a separation wall for enhanced separation of produced metal and gas.

It is an object of the present invention to provide a method and an electrowinning cell for production of aluminium by the electrowinning of aluminous ore, preferably aluminium oxide, in a molten fluoride electrolyte, preferably based on cryolite, at temperatures in the range 680–980° C. The said method is designed to overcome problems related to the present production technology for electrowinning of aluminium, and thus providing a commercial and economically viable process for said production. This means the design of an electrolysis cell with the necessary cell components and outline to reduce energy consumption, reduce overall production costs and still maintain high current efficiency. The compact cell design is obtained by the use of dimensionally stable anodes and aluminium wettable cathodes. The internal electrolyte flux is designed to attain a high dissolution rate of alumina, even at low electrolyte temperatures, and a good separation of the two products from the electrolysis process. Problems identified with the mentioned patents (U.S. Pat. Nos. 4,681,671, 5,006,209, 5,725,744 and 5,938,914) are also not encountered in this invention due to the more sophisticated design of the electrolysis cell.

A governing principle in the present invention related to an electrolysis cell for the accomplishment of aluminium electrolysis, and for the construction principle of the aluminium electrowinning cell, is that the two products, aluminium and oxygen, shall be efficiently collected with minimal losses due to the recombination of these products. The impediment of this recombination is accomplished through rapid and complete separation of aluminium and oxygen. This is sought realised through the forced convection of the metal and the gas/electrolyte in opposite directions, in such a manner as to achieve maximal differences in the actual velocity vectors of the two products.

These and other advantages can be achieved by the invention as defined in the accompanying claims.

In the following, the invention shall be further described by figures and an example where:

FIG. 1: Shows a schematic view of the vertical cross section longitudinally of the electrolysis compartment of an electrolysis cell according to the invention, FIG. 2: Shows a vertical cross section transverse of the electrolysis cell shown in FIG. 1.

Figure 2:
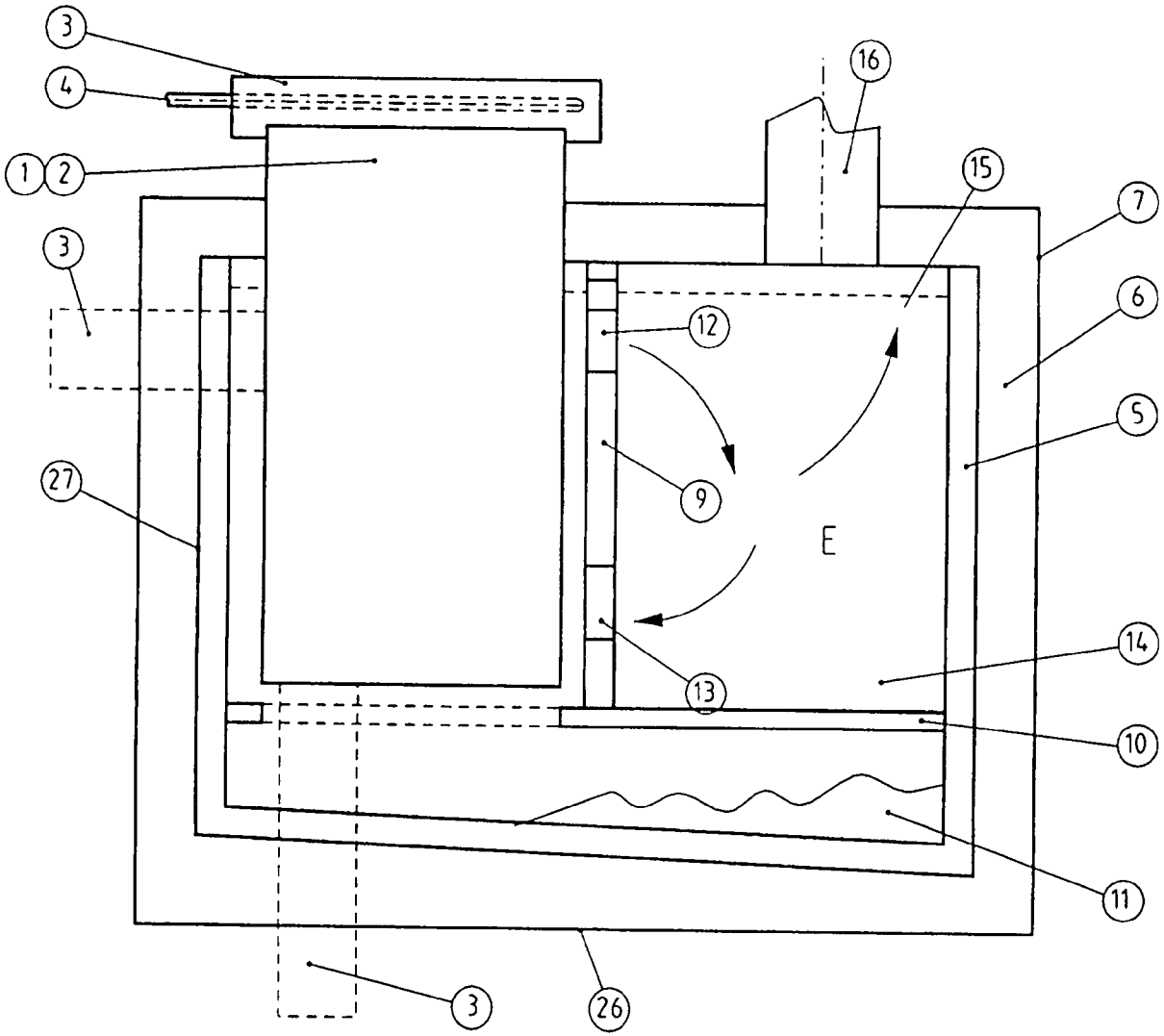

FIGS. 1 and 2 disclose a cell for the electrowinning of aluminium comprising anodes 1 and cathodes 2 immersed in an electrolyte E contained in an electrolysis chamber 22. In operation, the electrolyte will be separated from the upward rising gas bubbles 15 (FIG. 2) by deflection in a direction more or less perpendicular to the gas stream in the interpolar space 18 (FIG. 1) between the interleaved multi-monopolar or bipolar electrodes, where the gas is evolved at the inert anode surface 1. The electrolyte, containing some oxygen bubbles of smaller size (15) will be deflected into a gas separation chamber 14 (FIG. 2) through one or more openings 12 in the partition wall 9. In this chamber the electrolyte flow rate is reduced to enhance the gas separation. The gas-free electrolyte is then lead into the electrolysis chamber through corresponding openings 13 in the partition wall, providing a flow of "fresh" electrolyte into the interpolar space 18. In principal, the separation wall 9 can be constructed without openings (12, 13), and the circulation of the electrolyte between the electrolysis chamber 22 and the gas separation chamber 14 can then be obtained by limiting the extent of the partition wall. In practice this can be achieved by allowing a gap between an auxiliary floor 10 and the lower end of the partition wall 9, and a gap of similar dimensions between the top of the partition wall 9 and the upper electrolyte level.

The produced aluminium will flow downward on the aluminium wettable cathode surfaces 2 in the opposite direction of the electrolyte and the rising gas bubbles. The produced aluminium will pass through holes 17 of the auxiliary cell floor 10, and will be collected in an aluminium pool 11 shielded from the flowing electrolyte in a metal compartment 23. The metal can be extracted from the cell through a hole suitably located through the cell lid 8, or through one or more surge pipes/siphons 19 attached to the cell. It is a principle of the present invention to arrange the electrodes 1, 2 and the partition wall 9, as well as the auxiliary cell floor 10, so as to achieve a balance between the buoyancy-generated bubble forces (gas-lift effect) on one side and the flow resistance on the other hand to give a net motion of the electrolyte to provide the required alumina dissolution and supply, as well as separation of the products. Preferably the partition wall 9 extends between two opposing side walls 24, 25 of the cell. Its height may extend from the bottom 26 or the auxiliary floor of the cell and upward to at least the surface of the electrolyte. The height can be limited to allow full exchange of gas between the electrolysis chamber 22 and the gas separating chamber 14.

The cell is located in a steel container 7, or in a container made of another suitable material. The container has a thermal insulating lining 6 and a refractory lining 5 with excellent resistance to chemical corrosion by both fluoride-based electrolyte and produced aluminium 11. The floor of the cell is formed to create a natural drainage of the aluminium to a deeper pool for easy extraction of produced metal from the cell. Alumina is preferably fed through one or more pipes 20 and into the highly turbulent flow region of the electrolyte in the electrolysis chamber between the electrodes of the cell. This will allow a fast and reliable dissolution of alumina, even at low bath temperatures and/or high cryolite ratios of the electrolyte. Optionally, the alumina can be fed into the gas separation chamber 14. The electrodes are connected to a peripheral busbar system through connections 3, in which the temperatures can be controlled through a cooling system 4.

The off-gasses formed in the cell during the electrolysis process will be collected in the top part of the cell above the gas separation and the electrolysis chamber. The off-gases can then be extracted from the cell through an exhaust system 16. The exhaust system can be coupled to the alumina feeding system 20 of the cell, and the hot off-gasses can be utilised for preheating of the alumina feed stock. Optionally, the finely dispersed alumina particles in the feed stock may act as a gas cleaning system, in which the off-gasses are completely and/or partially stripped from any electrolyte droplets, particles, dust and/or fluoride pollutants in the off-gasses from the cell. The cleaned exhaust gas from the cell is then connected to the gas collector system (28) of the potline.

The present cell design achieves reduced contact time and reduced contact area between the metal and the electrolyte. Hence, the unfortunate consequence of previously known design solutions is avoided, where a relatively large surface area of molten aluminium is kept in contact with the electrolyte, and renders possible the enhanced accumulation of dissolved anode material in the produced metal. The contact area of the cathode, i.e. the downward flowing aluminium may be even further reduced by reducing the cathode surface area relative to the anode surface area. A reduction in the exposed cathodic surface area will reduce the contamination levels of anode material in the produced metal, thus reducing the anodic corrosion during the electrolysis process. A reduction in the anodic corrosion can also be obtained by reducing the anodic current density and by lowering of the operating temperature.

A novel concept of the invented cell is the implementation of an auxiliary cell floor. By means of the gas produced at the anode, a gas-lifting effect is created, setting up a desired circulation pattern in the electrolyte. This circulation pattern transports the produced gas upward and away from the downward flowing aluminium. The optional introduction of diaphragms, interior walls or "skirts" 21 (FIG. 1) between the anodes 1 and the cathodes 2 may under certain circumstances enhance the preferred circulation pattern of the electrolyte, and the diaphragms may also reduce the downward circulation of the electrolyte along the cathode surfaces by means of reducing the natural tendency for a downward movement of the electrolyte. Due to the large volume of the gas separation chamber 14 relative to the total interpolar volumes, the gas separation chamber will act as a de-gaser for any oxygen gas "trapped" in the electrolyte, thus allowing for an essentially gas-free electrolyte to be circulated back to the electrolysis chamber. The communication between the electrolysis chamber and the gas separation chamber takes place through "openings" in the partition wall inserted in the cell, and the size and position of these "openings" (12 and 13) determine the flow pattern as well as the flow rates in the cell.

The shown multi-monopolar anodes 1 and cathodes 2 may obviously be manufactured as several smaller units and assembled to form an anode or cathode of the desired dimensions. In addition, except for the end electrodes, all interleaved inert anodes 1 and aluminium wettable cathodes 2 can be exchanged by bipolar electrodes, which may be designed and positioned in the same manner. This alignment will cause the end electrodes in the cell to act as a terminal anode and terminal cathode, respectively. The electrodes are preferably arranged in a vertical alignment, but cantilevered/tilted electrodes can also be used. Also tracks (grooves) in the electrodes may be applied to improve the separation and collection/accumulation of produced gas and/or metal.

Continuous operation of the electrolysis cell requires the use of dimensionally stable inert anodes 1. The anodes are preferably made of metals, metal alloys, ceramic materials, oxide based cermets, oxide ceramics, metal ceramic composites (cermets) or combinations thereof, with high electrical conductivity. The cathodes 2 must also be dimensionally stable and wettable by aluminium in order to operate the cell at constant interpolar distances 18, and the cathodes are preferably made from titanium diboride, zirconium diboride or mixtures thereof, but may also be made from other electrically conducting refractory hard metals (RHM) based on borides, carbides, nitrides or silicides, or combinations and/or composites thereof. The electrical connections to the anodes are preferably inserted through the lid 8 as shown in FIGS. 1 and 2. The connections to the cathodes may be inserted through the lid 8, through the long side walls 27 (FIG. 2) or through the cell bottom 26.

The invented cell can be operated at low interpolar distances 18 to save energy during aluminium electrowinning. The productivity of the cell is high, as vertical electrodes provide large electrode surface areas and a small "footprint" of the cell. Low interpolar distances mean that the heat generated in the electrolyte is reduced compared to traditional Hall-Hèroult cells. The energy balance of the cell can hence be regulated by designing a correct thermal insulation 6 in the sides 24, 25, 27 and the bottom 27 is necessary, as well as in the cell lid 8. The cell can then optionally be operated without a frozen ledge covering the side walls, and chemically resistant cell materials is in such cases a matter of necessity. However, the cell can also be operated with a frozen ledge covering, at least parts of, the sidewalls 24, 25, 27 and bottom 26 of the cell.

Excess heat generated must be withdrawn from the cell through the water-cooled electrode connections 3,4 and/or the use of auxiliary means of cooling like heat pipes, etc. Depending on the desired heat balance and operating conditions of the cell, the heat retracted from the electrodes may be used for heat/energy recovery. The cell liner 5 is preferably made of densely sintered refractory materials with excellent corrosion resistance toward the used electrolyte and aluminium. Suggested materials are alumina, silicon carbide, silicon nitride, aluminium nitride, and combinations thereof or composites thereof. Additionally, at least parts of the cell lining can be protected from oxidising or reducing conditions by utilising protective layers of materials that differs from the bulk of the dense cell liner described above. Such protective layers can be made of oxide materials, for instance aluminium oxide or materials consisting of a compound of one or several of the oxide components of the anode material and additionally one or more oxide components. The auxiliary cell floor 10, partition wall 9 and diaphragms 21 can also be made of densely sintered refractory materials with excellent corrosion resistance toward the used electrolyte and aluminium. Suggested materials are alumina, silicon carbide, silicon nitride, aluminium nitride, and combinations thereof or composites thereof. The two latter units (9,21) can also utilise other protective materials in at least parts of the construction, where the protective layers can be made of oxide materials, for instance aluminium oxide or materials consisting of a compound of one or several of the oxide components of the anode material and additionally one or more oxide components.

The shape and design of the degassing or gas separation chamber may vary depending on the production capacity of the cell. The gas separation chamber may in reality consist of several chambers placed on either side of the electrolysis chamber, or consist of one or more chambers separating two adjacent electrolysis compartments, or consist of one or more chambers alongside the electrolysis chamber as shown in FIG. 2. The gas separation chamber may also be opened during cell operation for drainage/removal of any alumina sludge accumulated in the cell.

The invented cell is designed for operation at temperatures ranging from 680° C. to 970° C., and preferably in the range 750–940° C. The low electrolyte temperatures are attainable by use of an electrolyte based on sodium fluoride and aluminium fluoride, possibly in combination with alkaline and alkaline earth halides. The composition of the electrolyte is chosen to yield (relatively) high alumina solubility, low liquidus temperature and a suitable density to enhance the separation of gas, metal and electrolyte. In one embodiment, the electrolyte comprises a mixture of sodium fluoride and aluminium fluoride, with possible additional metal fluorides of the group 1 and 2 elements in the periodic table according to the IUPAC system, and the possible components based on alkali or alkaline earth halides up to a fluoride/halide molar ratio of 2.5, and where the $NaF/AlF_3$ molar ratio is in the range 1 to 3, preferably in the range 1.2–2.8.

It should be understood that the suggested aluminium electrowinning cell as presented in the example relating to FIGS. 1 and 2, represents only one particular embodiment of the cell, which may be used to perform the method of electrolysis according to the invention.

The invention claimed is:

1. A cell for electrolytic production of aluminium comprising at least one electrolysis chamber containing an electrolyte, at least one inert anode and at least one wettable cathode, wherein:

a gas separating chamber is arranged in communication with said electrolysis chamber, where gas evolved in the electrolysis process is directed to flow into the gas separation chamber thus establishing an electrolyte flow pattern between the electrolysis chamber and the separation chamber, where gas evolved in the process can be separated from the electrolyte in the gas separation chamber;

the electrolysis chamber comprises an auxiliary floor; and at least one diaphragm, interior wall or skirt is positioned between at least one anode and at least one cathode.

2. An electrolysis cell in accordance with claim 1, wherein:

a partitioning wall is arranged between the electrolysis chamber and the gas separating chamber, said wall having at least one opening formed therethrough.

3. An electrolysis cell in accordance with claim 2, wherein the partitioning wall has at least one upper opening allowing the gas-containing electrolyte to flow from the electrolysis chamber to the gas separating chamber, and at least one lower opening through which electrolyte separated from the gas returns to the electrolysis chamber.

4. An electrowinning cell in accordance with claim 2, wherein the partitioning wall is manufactured from aluminum oxide, aluminium nitride, silicon carbide, silicon nitride or combinations or composites thereof.

5. An electrowinning cell in accordance with claim 2, wherein the partitioning wall is manufactured from oxide materials.

6. An electrowinning cell in accordance with claim 2, wherein the partitioning wall is manufactured from oxide or materials consisting of a compound of one or several of the oxide components of the anode material, and additionally one or more oxide components.

7. An electrowinning cell in accordance with claim 2, wherein the partitioning wall extends between two opposing side walls of the cell, where its height may extend from the bottom or the auxiliary floor of the cell and upward to at least the upper level of the electrolyte.

8. An electrolysis cell in accordance with claim 2, wherein the partitioning wall has a vertical extension and is further arranged such that an opening is provided below the lower end of the partitioning wall, and an opening of similar dimensions is provided between the upper end of the partitioning wall and the upper level of the electrolyte.

9. An electrowinning cell in accordance with claim 1, wherein the gas separating chamber has a volume large enough to reduce electrolyte flow rates sufficiently to separate any gas contained in the electrolyte.

10. An electrowinning cell in accordance with claim 1, wherein one or more gas separating chambers can be arranged alongside at least one side of the cell.

11. An electrowinning cell in accordance with claim 1, wherein the gas separating chamber is connected to at least one gas exhaust system for extracting and collecting gases from the chamber.

12. An electrowinning cell in accordance with claim 1, further comprising an exhaust system connected to an alumina feeding system in which hot off-gasses are used for heating alumina feed stock and/or used for scrubbing cleaning of off-gasses from the cell to remove fluoride vapors, fluoride particulate and/or dust before entering a gas collection system.

13. An electrowinning cell in accordance with claim 1, wherein the auxiliary floor is provided with at least one hole arranged below the cathode, whereby aluminium is allowed to pass through said hole and to be collected in a metal compartment defined below said floor.

14. An electrowinning cell in accordance with claim 13, wherein the auxiliary floor material is selected from aluminium nitride, silicon carbide, silicon nitride, oxide materials, refractory hard materials based on borides, carbides, nitrides, silicides or combinations or composites thereof.

15. An electrowinning cell in accordance with claim 13, wherein said aluminium in the metal compartment can be extracted from the cell via one or more surge pipes or siphons attached to the cell.

16. An electrowinning cell in accordance with claim 1, wherein the anodes and the cathodes are of a monopolar type arranged in an alternate manner, and further aligned vertically or inclined.

17. An electrowinning cell in accordance with claim 1, wherein the anodes and cathodes are of the bipolar type aligned vertically or inclined.

18. An electrowinning cell in accordance with claim 1, wherein the anodes and/or the cathodes consists of a plurality of smaller units integrated in one larger unit.

19. An electrowinning cell in accordance with claim 1, wherein the anodes are manufactured from dimensionally stable materials, including oxide based cermets, metals, metal alloys, oxide ceramics, and combinations or composites thereof.

20. An electrowinning cell in accordance with claim 1, wherein the cathodes are manufactured from electrically conductive refractory hard materials (RHM) based on borides, carbides, nitrides, silicides or mixtures thereof.

21. An electrowinning cell in accordance with claim 1, wherein main surfaces of the at least one anode and the at least one cathode are arranged in a manner adjacent to a short side wall of the cell.

22. An electrowinning cell in accordance with claim 1, wherein the cell has a lining that includes an electrically non-conductive material.

23. An electrowinning cell in accordance with claim 22, wherein the material of the cell lining is selected from aluminium oxide, aluminium nitride, silicon carbide, silicon nitride, and combinations thereof or composites thereof.

24. An electrowinning cell in accordance with claim 22, wherein the cell lining is manufactured from oxide materials.

25. An electrowinning cell in accordance with claim 22, wherein at least part of the cell lining is manufactured from oxide or materials formed of a compound of one or several of the oxide components of the anode material, and additionally one or more oxide components.

26. An electrowinning cell in accordance with claim 1, wherein the at least one anode and the at least one cathode are connected to a periphery busbar system for electrical supply, wherein the connections can be introduced through the top, the sides or the bottom of the cell.

27. An electrowinning cell in accordance with claim 1, wherein the anodes and/or cathodes connections are cooled to provide heat exchange and/or heat recovery from said anode/cathode, and/or temperature control.

28. An electrowinning cell in accordance with claim 1, wherein the anode and/or cathode connections are cooled by means of water cooling or other liquid coolants, by gas cooling or by the use of heat pipes.

29. An electrowinning cell in accordance with claim 1, further comprising at least one feeding tube for alumina where its inlet is located either at a position being close to a high-turbulence part in the electrolyte, and in the interpolar space between one anode and one cathode, or in the gas separation chamber.

30. An electrowinning cell in accordance with claim 1, wherein the electrolyte flow pattern can be enhanced by the at least one diaphragm, interior wall or skirt which is operable to deflect the upward flowing electrolyte into the gas separation chamber.

31. An electrowinning cell in accordance with claim 1, wherein the diaphragm is manufactured from aluminum oxide, aluminium nitride, silicon carbide, silicon nitride or combinations or composites thereof.

32. An electrowinning cell in accordance with claim 1, wherein the diaphragm is manufactured from oxide materials.

33. An electrowinning cell in accordance with claim 1, wherein the diaphragm is manufactured from oxide or materials formed of a compound of one or several of the oxide components of the anode material, and additionally one or more oxide components.

34. An electrowinning cell in accordance with claim 1, wherein the electrolyte comprises a mixture of sodium fluoride and aluminium fluoride, with additional metal fluorides of the group 1 and 2 elements in the periodic table according to the IUPAC system, and the components based on alkali or alkaline earth halides up to a fluoride/halide molar ratio of 2.5, and where the $NaF/AlF_3$ molar ratio is in the range 1 to 3.

35. An electrowinning cell in accordance with claim 30, wherein the diaphragm is manufactured from aluminum oxide, aluminium nitride, silicon carbide, silicon nitride or combinations or composites thereof.

36. An electrowinning cell in accordance with claim 30, wherein the diaphragm is manufactured from oxide materials.

37. An electrowinning cell in accordance with claim 30, wherein the diaphragm is manufactured from oxide or materials including a compound of one or several of the oxide components of the anode material, and additionally one or more oxide components.

* * * * *